US006882282B1

(12) United States Patent
Lie-Nielsen et al.

(10) Patent No.: US 6,882,282 B1
(45) Date of Patent: Apr. 19, 2005

(54) OBJECT STORAGE AND LOCATION TRACKING SYSTEM WITH REMOTELY STORED AND ACCESSIBLE DATA

(75) Inventors: John Lie-Nielsen, Bradenton, FL (US); Tibor Szenti, Sarasota, FL (US)

(73) Assignee: HandyTrack Key Control Systems, LLC, Bradenton, FL (US)

( * ) Notice: Subject to any disclaimer, the term of this patent is extended or adjusted under 35 U.S.C. 154(b) by 89 days.

(21) Appl. No.: 10/638,081

(22) Filed: Aug. 7, 2003

(51) Int. Cl.[7] ..... G08B 21/00

(52) U.S. Cl. ..... 340/686.1; 340/568.1; 235/375; 235/385

(58) Field of Search ..... 340/686.1, 568.1, 340/568.2, 568.7; 235/375, 381, 385

(56) References Cited

U.S. PATENT DOCUMENTS

| | | | | |
|---|---|---|---|---|
| 5,774,053 A | * | 6/1998 | Porter | 340/568.1 |
| 5,801,628 A | | 9/1998 | Maloney | |
| 6,075,441 A | | 6/2000 | Maloney | |
| 6,131,808 A | | 10/2000 | Pires et al. | |
| 6,195,005 B1 | | 2/2001 | Maloney | |
| 6,204,764 B1 | | 3/2001 | Maloney | |
| 6,232,876 B1 | | 5/2001 | Maloney | |
| D444,331 S | | 7/2001 | Maloney | |
| 6,262,664 B1 | | 7/2001 | Maloney | |
| D456,852 S | | 5/2002 | Maloney | |
| 6,392,543 B1 | | 5/2002 | Maloney | |
| 6,404,337 B1 | * | 6/2002 | Van Till et al. | 340/569 |
| 6,407,665 B1 | | 6/2002 | Maloney | |
| 6,424,260 B1 | | 7/2002 | Maloney | |
| 6,427,913 B1 | | 8/2002 | Maloney | |
| 6,431,438 B1 | | 8/2002 | Pires et al. | |
| 6,501,379 B1 | | 12/2002 | Maloney | |
| 6,505,754 B1 | | 1/2003 | Kenny et al. | |
| 6,592,028 B1 | | 7/2003 | Pires et al. | |
| 6,707,380 B1 | * | 3/2004 | Maloney | 340/568.1 |

* cited by examiner

*Primary Examiner*—John Tweel, Jr.
(74) *Attorney, Agent, or Firm*—Bryan W. Bockhop; Arnall Golden Gregory LLP

(57) ABSTRACT

A system and method of tracking the location of stored objects, such as keys, that maintains object-tracking data in a remote data storage that is accessible via the Internet. A storage container selectively provides access to one or more uniquely identifiable objects stored within, such as keys, through an access control that gathers the tracking data generated from the removal and return of each object. The access control further includes an output for selective transmission of the object-tracking data over a network to a remote data store that stores and provides access to the stored object-tracking data to other computer devices on the Internet. The data store can provide the object tracking data to other computer devices, visually summarize the data in a report to a user, and can alter data stored at the access control.

26 Claims, 4 Drawing Sheets

80

82 HandyTrac Key Control Report on 2/2/2003 88

| Employee | Location (84) | Actvity (86) | Date | Time |
|---|---|---|---|---|
| J. Williams | 18 | 30MgmtActivity | 2/2/2003 | 07:32 |
| P. Jones | 7 | 51HVACRepair | 2/2/2003 | 10:41 |
| L. Sanchez | 3 | 14ShowUnit | 2/2/2003 | 16:23 |
| R. Smith | 45 | 27PestControl | 2/2/2003 | 17:01 |
| ..... | | | | |

OBJECT STORAGE AND LOCATION TRACKING SYSTEM WITH REMOTELY STORED AND ACCESSIBLE DATA

BACKGROUND OF THE INVENTION

1. Field of the Invention

The present invention generally relates to securable storage containers and location tracking systems for objects stored in the container. More particularly, the invention relates to a tracking system for objects, such as keys, stored in a secure container wherein the tracking data for the objects is preferably remotely stored and accessible through the Internet.

2. Description of the Related Art

It is desirous to track the location and persons in possession of various objects of value, such as keys, computer disks, medicines, records, and other valuable items. Basic systems used to track objects have been log books kept in proximity to the object storage site, and a person signs the log book when he or she takes or returns an object from the storage location. However, this system is dependent on the person to actually use the log book and accurately record the data of who has the object and where the object is located.

With the advent of computerized record storage, computerized object tracking systems have been created especially for tracking the location and storage of keys. These systems typically include a secure container or box that stores the keys, and a data input tracks the removal and return of the keys to the container. The data for the keys can be collected from a person taking the key, although this data input system is subject to the same error possibilities as log books. Some of the systems use a data store attached to an object, such as a bar code, or magnetic or optical strip, and the person simply scans the data at the time of object removal or return. This system is more likely to correctly gather data as the person can more easily scan the data at the appropriate times. Yet other systems use a radio-frequency (RF) tag on the object such that the object can be tracked by external devices when that object is in a monitored space.

One problem that occurs in these automated tracking systems is that the storage of the tracking data for the tracked objects is kept proximate to the storage container, such as in an electronic access control that provides access to the storage container. The access control typically includes a printer port such that it can print the tracking data, however, a person can only access this data at the access control. Further, the tracking data is stored at the access control and if the control fails or is destroyed, all stored data that was not recorded elsewhere is lost.

Accordingly, it would be advantageous to provide a system and method that allows the remote storage of data for tracked objects, such as keys, so that persons can access the tracking data without needing to have physical access to the access control for the object. Such system should allow the automatic periodic storage of the tracking data such that the risk of data loss at the access control is minimized. It is thus to the provision of such a system and method that the present invention is primarily directed.

SUMMARY OF THE INVENTION

The present invention is a system and method for tracking the location of objects of value, such as keys, using a storage container that selectively provides access to one or more stored uniquely identifiable objects and an access control proximate to the storage container provides a user access to the container and gathers the tracking data generated from the removal from and return of each object to the storage container. The access control has a data output for selective transmission of the object-tracking data over a network to a remote data store, and the data store is accessible to other computer devices through the network. Thus, the access control selectively transmits gathered object-tracking data across the network to the data store and the data store selectively stores and provides access to the object-tracking data across the network to the other computer devices. The transmission of the object-tracking data can occur at the time of gathering, i.e. when the object is removed or returned from the storage container, or the data can be stored at the access control and then periodically be forwarded to the data store.

The method for remotely storing object-tracking data across a computer network includes the steps of interacting with one or more uniquely identifiable objects within the storage container, generating object-tracking data from the interaction with each object, the generation occurring at the access control proximate to the storage container, transmitting the object-tracking data from the access control to a data store across a network, storing the transmitted object-tracking data at the data store, and then selectively providing access to other computers on the network to the object-tracking data at the data store. The method can also include the step of storing the gathered object data at the access control and then periodically transmitting the stored data to the data store, such as via a data call over a modem.

It is therefore an object of the system and method to provide a system and method that allows the remote storage of object-tracking data so that persons can access the tracking data without needing to have physical access to the storage container or access control to get the data. In one embodiment, the system further allows the automatic transmission of the object-tracking data stored at the access control to the data store to provide a backup of the tracking data for the storage container. Further, the transmission of the object-tracking data to the data store allows aggregation and manipulation of the data in a more powerful and versatile manner than would be possible solely at the access control.

Other objects, advantages, and features of the present invention will become apparent after review of the hereinafter set forth Brief Description of the Drawings, Detailed Description of the Invention, and the claims.

DETAILED DESCRIPTION OF THE INVENTION

Figure 1:
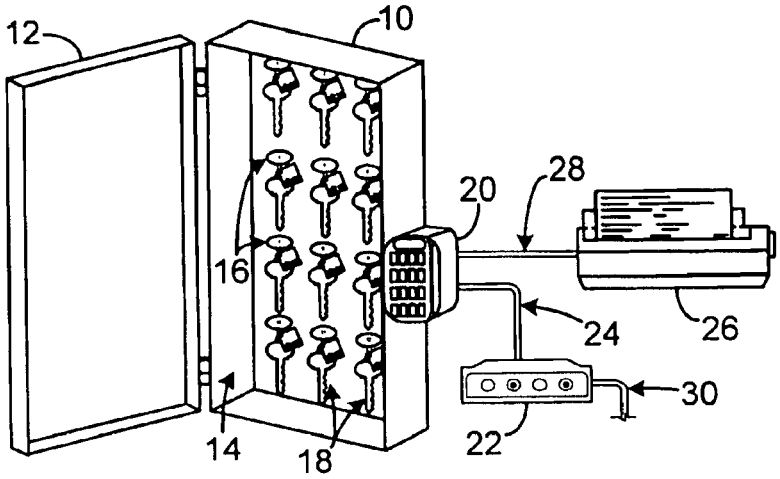
FIG. 1 is a perspective view of one embodiment of the object storage container and access control with an attached printer and modem for network connectivity.

With reference to the figures in which like numerals represent like elements throughout, FIG. 1 illustrates an embodiment of the object storage container 10 having a door 12 to a selectively accessible interior 14 thereof such that the container selectively provides access to one or more objects, such as keys 18, stored therewithin. In the interior 14 is a plurality of discrete and identifiable object holders 16, such as hooks, drawers, recesses, or other discrete implements to hold a key or other object. Each holder selectively storing at least one key 18, and each key 18 is uniquely identifiable, such as with the bar code tag 30 in FIG. 4A. Thus, a person can store and remove one or more keys 18 from a holder 16 through use of the access control 20. An example of such a key control system is currently sold by HandyTrac® Systems.

Figure 2:
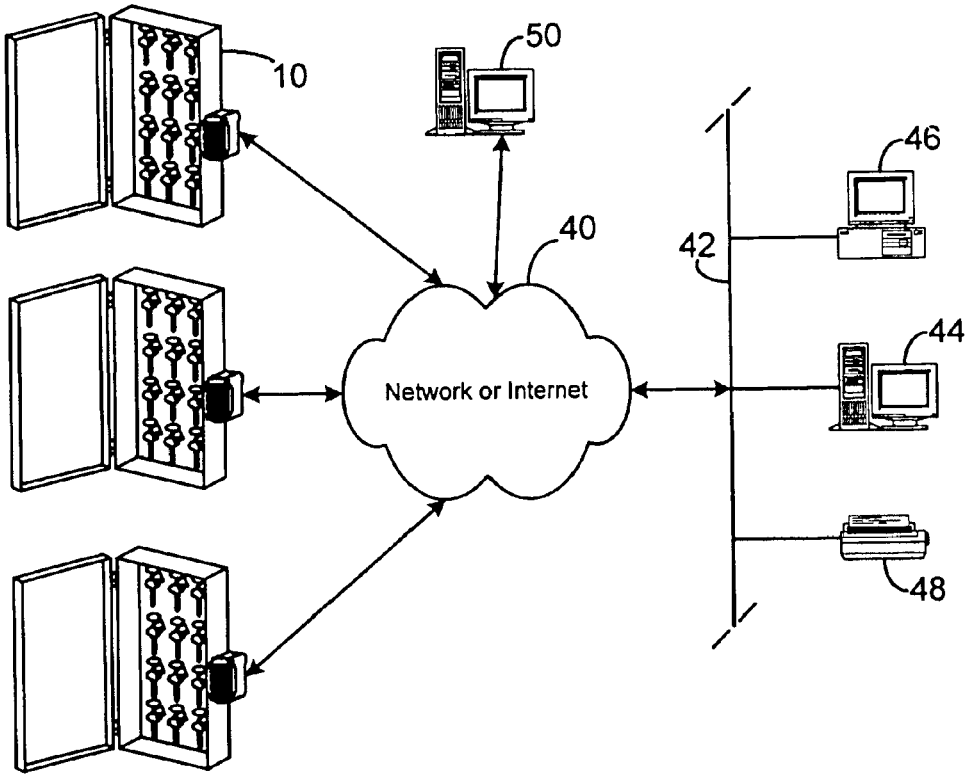
FIG. 2 is a network diagram of a plurality of storage containers networked to a LAN including a server and other devices for handling transmitted object-tracking data.
Figures 5, 6:
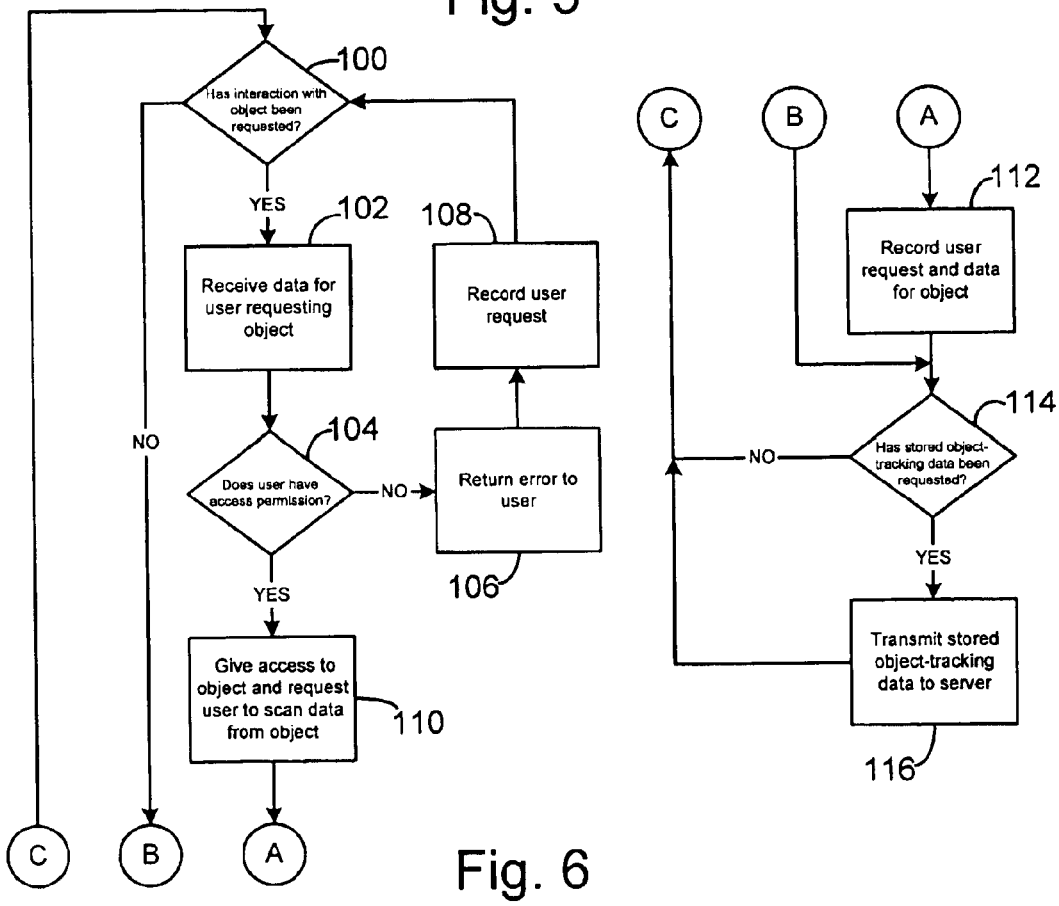
FIG. 5 is a report generated by the server-side devices and which displays the transmitted and stored object-tracking data.
FIG. 6 is a flowchart of one embodiment of the process executed at the access control of the storage container in gathering object-tracking data and transmitting the data across the network to the data store.

The access control 20 includes a modem 22 attached to the access control 20 via a line 24, and also to a network (40 in FIG. 2) via a phone line 30, such that the access control 20 is selectively in communication with a network and/or the Internet (40 in FIG. 2). The access control 20 is also shown here as embodied with a peripheral printer 26, attached via line 28, whereby the printer 26 can generate reports, such as shown in FIG. 5, at the location of the storage container 10. The output of the access control 20 can also be a LAN connection, as known in the art, or a wireless network connection, such as shown in FIG. 3.

FIG. 2 illustrates a location tracking system a plurality of storage containers 10, each holding tracked object, and the storage containers 10 are networked through the Internet 40 to a LAN 42 including a server 44 and other devices for handling transmitted object-tracking data. The system thus includes at least one storage container 10 having a selectively accessible interior 14 thereof and which selectively provides access to one or more uniquely identifiable objects stored therewithin, such as keys 18, and an access control 20 is proximate to the storage container 10. The access control 20 at least gathers the tracking data generated from the removal and return of each object that is stored in the storage container 10, and the access control 20 further including an output for selective transmission of the object-tracking data over the network 40, such as through the modem 22. Other computer devices, such as PC computer 50, are in communication with the Internet, and can access at least the server 44, or other data store for the stored object-tracking data.

A data store, such as server 44, is located remotely to the access control 20 and accessible thereto through the network 40, and the data store is also accessible to other computer devices through the network 40, or through the server-side LAN 42. The server-side can include other computers, such as PC 46, and can include peripheral devices, such as printer 48, for the physical generation of reports at the server-side, if desired.

Figure 3:
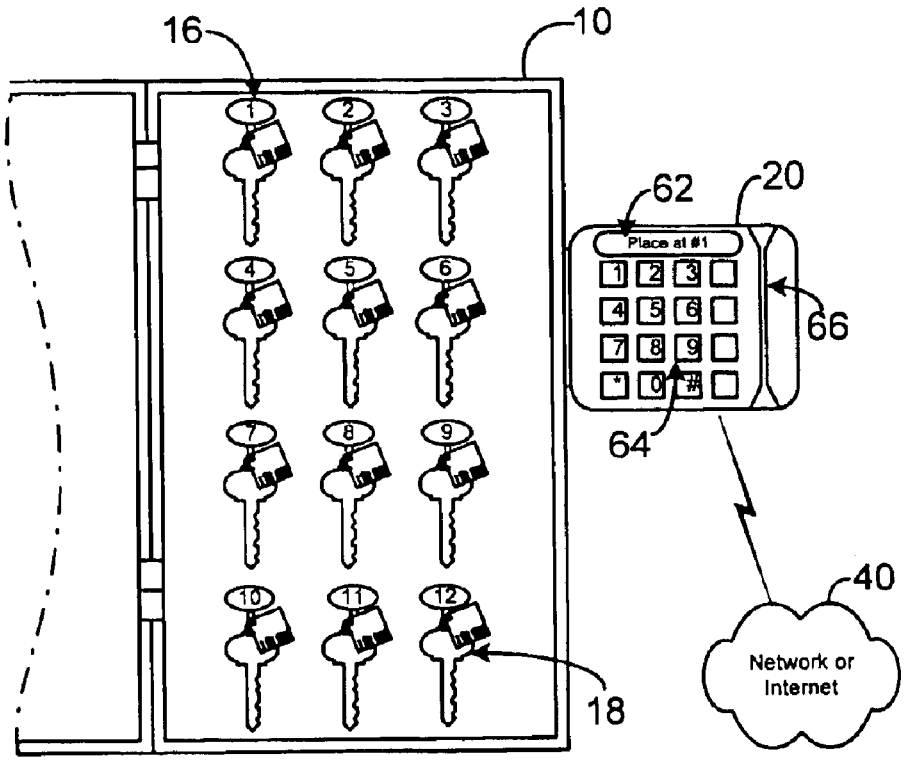
FIG. 3 is a front perspective view of a storage container and access control with a wireless connection to the Internet.

With reference to FIG. 3, the access control 20 preferably tracks the location of each key 18 at any of the plurality of holders 16 within the container 10. The access control 20 can also track other data such as the identity of the person taking the key 18, the particular location of the key 18, and the time at which the key 18 was taken. At the least, the access control 20 records if a key 18 is removed from a holder 16, and the identity of the user taking the key 18. While the stored object shown herein is a key 18, any other type of valuable object can be stored and tracked with the present system, such as computer disks, medicines, records, files, precious stones, jewelry, firearms, or any other valuable or restricted item, and the size of the container 10 and configuration of the holder 16 can be altered accordingly. The access control 20 is shown here as having a display 62, a keypad 64, and a reader 66 for a data store of the object, the user, or both. There is also a wireless network connection from the access control 20 to a network 40 such that the object-tracking data can be transmitted over the air to the Internet, as further described herein.

Figure 4A:
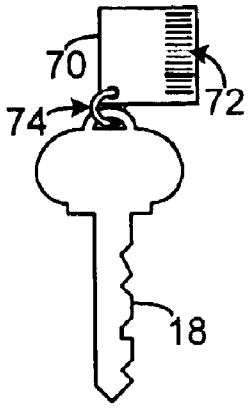
FIG. 4A is a perspective view of one embodiment of the data store on the key comprising a tag with a bar code.
Figure 4B:
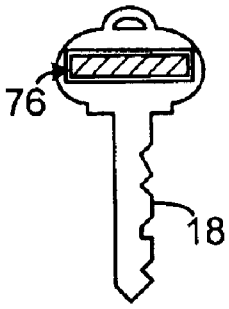
FIG. 4B is a perspective view of another embodiment of the data store on the key comprising an adhesively-attached magnetic strip.

As shown in the embodiments of FIGS. 4A and 4B, the object can be identifiable through having an attached data store, such as a bar code tag 70 in FIG. 4A, with a scannable bar code 72, and the tag 70 is attached to the key 18 with a ring 74 as is known in the art. An alternate embodiment of the data store shown in FIG. 4B, an adhesive magnetic strip 76 can be affixed to the key 18, and the strip can store the relevant data for the object. Thus, to implement the system, one typically must attach a data store to the object to thereby identify the object, such as attaching the bar code tag 70 to the key 18. Other data stores such as flash memory, optical codes, and RF tags can be alternately used to identify the objects. Further, if the attached data store is a barcode 72, the access control 20 can include an optical reader 66 to scan the bar code 72 and obtain the data for the key 18. And if the attached data store is a magnetic strip 76, the access control 20 will include a magnetic reader to scan the magnetic strip 76 and obtain the object-identifying data.

An important feature of the system is the ability to generate reports for the object-tracking data that is accessible through the network 40. FIG. 5 is an example of a report 80 that can be generated by the server-side devices, such as server 44 using printer 48. Such report can printed, displayed locally, or generated in a programming language, such as HTML or XML, and exported to another computer device across the network 40 for display. The report 80 should summarize the relevant object-tracking data for at least a single storage container 10, and the data can be aggregated to encompass many storage containers. For dynamic updating of the control log, the report 80 can be altered at the server 44 by authorized users and then the changes can be forced to the record at the access control 20 whereby the access control 20 and the server 44 will keep identical records. Alternately, the server 44 may not update the access control 20 with any changes to the record.

In the example shown, the key control report shows the employee 82 who took the object, the location 84 the key 18 was taken to, the activity 86 for which the key 18 was taken, and the date and time 88 the key 18 was taken. The report can be specialized to include other data such as by location, employee, activity, keys checked out or in, or the date or time. If object other than keys are tracked with the system, other descriptive data can be collected and displayed, such as amount of medicine remaining, whether the item is clean or not, indication of servicing, or any other data desired collected. The user will likely need to input the additional data at the time of object return, unless the data store of the object is dynamic, tracks data automatically, and inputs the data at the time of the object return as would be possible with a microprocessor or other smart object data store.

FIG. 6 is a flowchart of one embodiment of the process executed at the access control 20 of the storage container 10 in gathering object-tracking data and transmitting the data across the network 40 to the server 44, or other data store. To use the system, a person typically inputs their identifying data in order to obtain or return a key 18, or request another type of interaction with the key 18, as detected by decision 100. Such interaction can be a data swipe by the user in the reader 66, or input into keypad 64. If a request has been made at decision 100, then the data is received for the user requesting the object as shown at step 102. If no request has been made at decision 100, then the process makes a decision as to whether the stored object-tracking data has been requested, as shown at step 114. If the stored data has not been requested at decision 114, the process will return to decision 100 and await either user interaction or a request for the stored object data. At step 102, the person can also input any other necessary data, such as through keypad 64, such as the person's identifying data or other location information. If so embodied, the person can have a card with a data store, such as a bar code (similar to bar code 72 on tag 70 in FIG. 4A) and can swipe the data into the reader 66 for identification purposes.

After the data has been input, a determination is then made as to whether the user has permission to access the requested object, as shown at decision 104. If the user does not have permission, then an error is returned to the user, as shown at step 106, a record made of the request, as shown at step 108, and then the process returns to decision 100 to await user interaction and a request to transmit the stored object-tracking data. Otherwise, if the user has permission at decision 104, then access is given to the user, and optionally, the user is requested to scan the data from the data store of the object being removed. The access control 20 typically displays to the user, at display 62, the specific holder 18 to remove the object (such as key 18) from. A record of the user interaction and data for the object is then made, as shown by step 112, and such data is included in the stored object-tracking data. It should be noted that the access control can send the object-tracking data at the time it is gathered by the access control, and does not necessarily need the data to be stored as is shown in the embodiment in FIG. 6.

After the record of the user and object-tracking data is made at step 112, a determination is then made as to whether the stored-object tracking data is requested to be transmitted, as shown by decision 114. Such request typically comes from the server 44, or other data store across the network 40. If the stored data has not been requested at decision 114, the process will return to decision 100 and await either user interaction or a request for the stored object data. Otherwise, if the stored object-tracking data has been requested, then the stored object-tracking data is transmitted to the requesting computer device, such as server 44, as shown at step 116, and the process returns to decision 100 to await either user interaction or a request to transmit the stored object-tracking data.

In another embodiment, the access control 20, periodic transmission of the stored object-tracking data to a server 44 or other data store can occur, such as a nightly backup. The backup data transmission can thus occur at the time of lowest telecommunication cost, phone rate, or when it will be least disruptive. In such embodiment, the access control 20 can also respond to a request to send data, but also can solely periodically send the object-tracking data. The automatic periodic transmission of the stored object-tracking data ensures that the data is backed-up from the access control 20 so that if the access control 20 loses the stored data, all records of the object-tracking data is not lost. After the object-tracking data has been transmitted from the access control 20, the access control 20 can either keep a copy of the stored object-tracking data and overwrite it when necessary, or the access control 20 can delete its stored object-tracking data once successful transmission of it to the data store has occurred.

When return of a key 18 is the requested interaction at decision 100, the identifying process can be repeated, and the data for the key 18 can be obtained by swiping the bar code 32 of the key 18 into the reader 66 of the access control 20 such that the identifying data of the key 18 that is about to be stored at one of the plurality of object holders 16 is gathered by the access control 20. The access control 20 will then display to the user, at display 62, the specific holder 16 to place the key 18 at. The user will then store the key 18 at the assigned holder 16 within the storage container 10 and typically close the door 12 securing all keys 18. The access control 20 stores the data about the user returning the key 18 within the object-tracking data.

Figure 7:
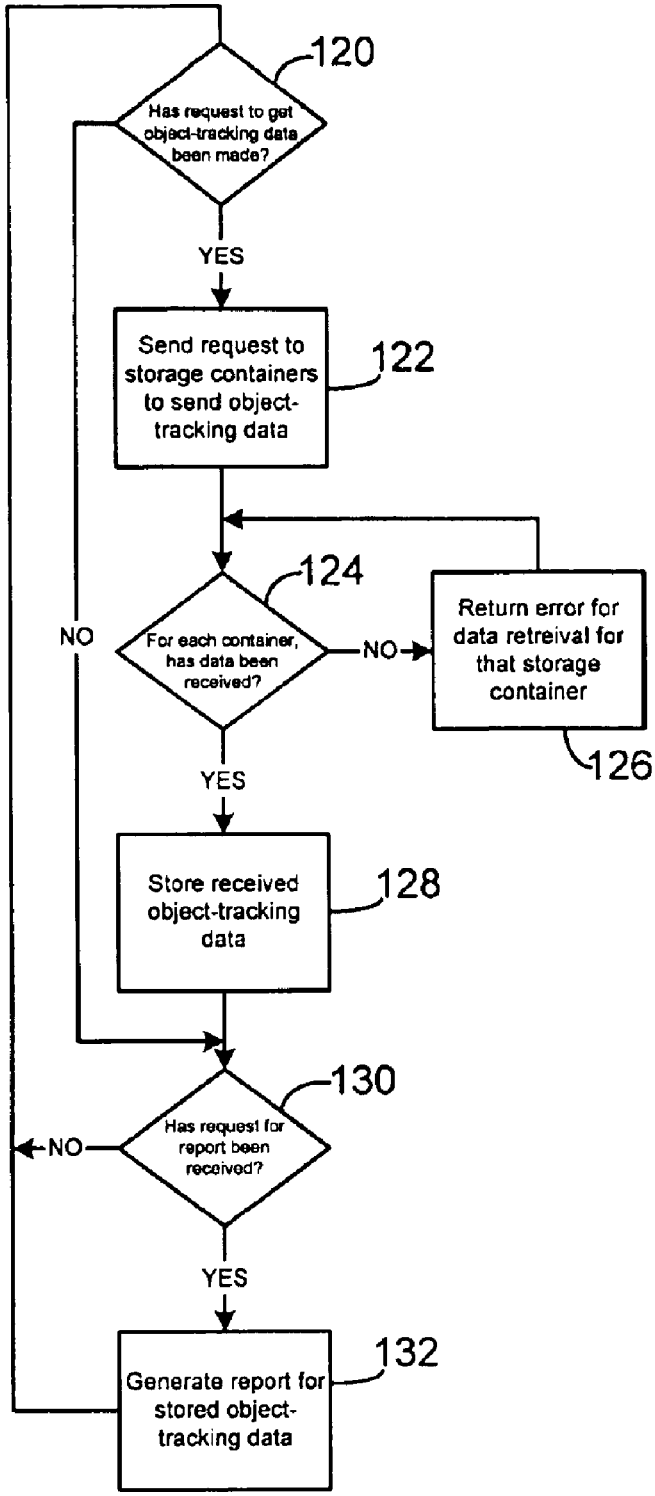
FIG. 7 is a flowchart of one embodiment of the process executed at the data store to selectively retrieve and store object-tracking data from the access controls of the storage containers.

FIG. 7 is a flowchart of one embodiment of the process executed at the data store, such as server 44, to selectively retrieve and store object-tracking data from the access controls 20 of the storage containers 10 utilizing the process of FIG. 6. The process awaits a request to get the object-tracking data from the storage containers 10, as shown at decision 120. If the retrieval request for the object-tracking data has not been received at decision 120, the process then forwards to make a determination as to whether a request to generate a report has been received, as shown at decision 130. Otherwise, if a request to retrieve the object-tracking data has been received at decision 120, a request is sent to the various storage containers 10 to send their stored object-tracking data, as shown at step 122. Then a decision is made as to whether, for each storage container 10 being tracked, the object-tracking data has been received, as shown at decision 124.

If the object-tracking data has not been received for a specific storage container 10, then an error is returned for that specific retrieval process, as shown at step 126, and then the process iterates to decision 124 unless the object-tracking data for all monitored storage containers 10 has been attempted retrieved. After retrieval of the object-tracking data, the retrieved object-tracking data is stored, as shown at step 128, and then a determination is made as to whether a report generation has been requested, as shown at decision 130. If a report has not been requested at decision 130, the process then returns to decision 120 to enter a wait state for a request to gather object-tracking data at decision 120 and await a request for a report at decision 130. Otherwise, once the report request has been received at decision 130, the report is generated comprised of the object-tracking data, as shown at step 132, and the process returns to decision 120. The report generation at step 132 can be a printing at the server-side, the display of the object-tracking data to a server-side device, or another computer device 50 across the network 40, or can also be the transmission of raw or processed object-tracking data to another computer device 50 that will then generate the report.

Alternate embodiments of the process executing on the data store, such as server 44, include the receipt of periodic transmission of the object-tracking data from the storage containers, either with or without the ability to send a request to the storage containers 10 to send the stored object-tracking data. If so embodied as solely receiving periodically transmitted object-tracking data, the data store will note the storage containers transmission of the data, or lack thereof, and can issue a notification upon a failure of a storage container 10 to transmit its object-tracking data at the designate periodic interval. Further, the request for the report can request a specific type of report, such as report 80, or can be for a specific data item or storage container 10 and can be in any format, and not solely in report form.

Consequently, the storage container 10, access control 20, and server 44, or other data store, provide an inventive method for remotely storing object-tracking data across a computer network 40, the object-tracking data occurring from the interaction with one or more uniquely identifiable objects, such as the keys 18, held within the storage container 10 and selectively removed therefrom. The method includes the steps of generating object-tracking data from the interaction with each object, such as removal and return of a key 18, the generation of data occurring at an access control 20 proximate to the storage container 10, and transmitting the object-tracking data from the access control 20 to a data store, such as server 44, across a network 40, where the data store is accessible to other computer devices, such as computer 50 through the network 40. Then method completes with the step of storing the transmitted object-tracking data at the data store (server 44), and then selectively providing access to other computers, such as computer 50, on the network 40 to the stored object-tracking data.

The method can include the steps of removing an object, such as a key from one of the plurality of object holders 18, and inputting into an access control 20 the identifying data of that removed object. To input the identifying data of the object, the method can include the step of attaching a data store, such as tag 70 or magnetic strip 76, to each object to thereby identify the object, and the input can occur from the step of scanning the data store to obtain the data for the object, and including that data within the object-tracking data.

If the access control 20 is embodied as shown in FIG. 1, the method can include the step of printing a report 80 comprised of the object-tracking data at the access control 20, and the step of transmitting the object-tracking data from the access control 20 is transmitting the object-tracking data from a modem 22 in connection to the access control 20. Alternately, the step of transmitting the object-tracking data from the access control 20 can be is transmitting from a LAN interconnection, or through a wireless connection, as shown in FIG. 3. The method can also include the steps of storing the gathered object-tracking data at the access control 20, and then selectively transmitting the stored object-tracking data from the access control 20 to the data store, such as server 44. It should be noted that the object-tracking data can be sent as soon as it is created at the access control 20, and in such case, the step of transmitting the object-tracking data is transmitting the data immediately after the user interaction has occurred.

While the foregoing disclosure shows illustrative embodiments of the invention, it should be noted that various changes and modifications could be made herein without departing from the scope of the invention as defined by the appended claims. Furthermore, although elements of the invention may be described or claimed in the singular, the plural is contemplated unless limitation to the singular is explicitly stated.

What is claimed is:

1. A location tracking system for objects, comprising:

at least one storage container having a selectively accessible interior thereof, the container selectively providing access to one or more uniquely identifiable objects stored therewithin;

an access control proximate to the storage container, the access control at least gathering the tracking data generated from the removal and return of each object that is stored in the storage container, the access control further including an output for selective transmission of the object-tracking data over a network;

a data store located remotely to the access control and accessible thereto through the network, and the data store further accessible to other computer devices through the network; and wherein the access control selectively transmits gathered object-tracking data across the network to the data store and the data store selectively stores and provides access to the object-tracking data across the network to the other computer devices.

2. The system of claim 1, wherein the object is a key.

3. The system of claim 1, wherein the object is identifiable through having an attached object data store.

4. The system of claim 1, wherein the access control further tracks the location of each object within the storage container.

5. The system of claim 1, wherein the data store is a server.

6. The system of claim 1, wherein the data store is a plurality of computers.

7. The system of claim 1, wherein the data store selectively stores the object-tracking data and provides reports comprised of the stored object-tracking data.

8. The system of claim 1, wherein the output of the access control is a modem.

9. The system of claim 1, wherein the output of the access control is a LAN connection.

10. The system of claim 1, wherein the access control further gathers data regarding the person removing or returning an object at the storage container and stores this data within the transmitted tracking data.

11. The system of claim 1, wherein the data store selectively transmits data to the access control to update any tracking data stored at the access control.

12. A location tracking system for objects, comprising:

a storage means for selectively providing access to one or more uniquely identifiable objects stored therewithin;

an access control means for at least tracking the data generated from the removal and return of each object that is stored in the storage means, the access control means proximate to the storage container and further including an output means for selective transmitting the object-tracking data over a network;

a data storage means for storing object-tracking data, the data storage means located remotely to the access control means and accessible thereto through the network, and the data storage means further accessible to other computer devices through the network; and wherein the access control means selectively transmits gathered object-tracking data across the network to the data storage means and the data storage means selectively stores and provides access to the object-tracking data across the network to the other computer devices.

13. A method for remotely storing object-tracking data across a computer network, the object-tracking data occurring from the interaction with one or more uniquely identifiable objects held within a storage container and selectively removed therefrom, the method comprising the steps of:

generating object-tracking data from the interaction with each object, the generation occurring at an access control proximate to the storage container;

transmitting the object-tracking data from the access control to a data store across a network, the data store further accessible to other computer devices through the network;

storing the transmitted object-tracking data at the data store; and selectively providing access to other computers on the network to the object-tracking data at the data store.

14. The method of claim 13, wherein the object-tracking data includes data about the removal and return of an object at the storage container.

15. The method of claim 13, further comprising the steps of:

removing an object from one of the plurality of object holders; and inputting into an access control the identifying data of that removed object.

16. The method of claim 13, wherein the steps of method track a key.

17. The method of claim 13, further comprising the step of attaching a data store to each object to thereby identify the object.

18. The method of claim 17, further comprising the step of scanning the data store to obtain the data for the object, and including that data within the object-tracking data.

19. The method of claim 13, further comprising the step of printing a report comprised of the object-tracking data at the access control.

20. The method of claim 13, wherein the step of transmitting the object-tracking data from the access control is transmitting the object-tracking data from a modem on the access control.

21. The method of claim 13, wherein the step of transmitting the object-tracking data from the access control is transmitting the object-tracking data from a LAN interconnection on the access control.

22. The method of claim 13, further comprising the steps of storing the gathered object-tracking data at the access control, and then selectively transmitting the stored object-tracking data from the access control to the data store.

23. The method of claim 22, further comprising the step of altering the stored object-tracking data at the access control through altering object-tracking data at the data store.

24. A method for remotely storing object-tracking data across a computer network, comprising the steps of:

a step for interacting with one or more uniquely identifiable objects within at least one storage container;

a step for generating object-tracking data from the interaction step with each object;

a step for transmitting the generated object-tracking data to a data store across a network;

a step for storing the transmitted object-tracking data at the data store; and a step for selectively providing access to other computers on the network to the object-tracking data stored at the data store.

25. A storage container that tracks the location of objects stored therewithin and removed therefrom, comprising:

a securable container having a selectively accessible interior thereof, the container selectively providing access to one or more uniquely identifiable objects stored within the interior;

an access control proximate to the container, the access control at least gathering the tracking data generated from the removal and return of each object that is stored in the storage container, and the access control further including a output for selective transmission of the object-tracking data over a network; and wherein the access control selectively transmits gathered object-tracking data across the network to one or more other computer devices.

26. A computer device for storing object-tracking data for objects stored in one or more storage containers having a selectively accessible interior thereof and selectively providing access to one or more uniquely identifiable objects stored therewithin, the computer device in selective communication with other computer devices across a network and receiving object-tracking data from one or more access controls, each access control proximate to a storage container and gathering the tracking data generated from the removal and return of each object that is stored in that storage container, and the access control selectively transmitting the object-tracking data to the computer device, and the computer device further storing and providing access of the stored object-tracking data to other computer devices.

* * * * *